US005423959A

United States Patent [19]

Sundblad et al.

[11] Patent Number: 5,423,959

[45] Date of Patent: Jun. 13, 1995

[54] PROCESS AND APPARATUS FOR THE PRODUCTION OF SULPHURIC ACID AND ALKALI METAL HYDROXIDE

[75] Inventors: Birgitta Sundblad; Göran Sundström, both of Sundsvall, Sweden

[73] Assignee: EKA Nobel AB, Bohus, Sweden

[21] Appl. No.: 264,251

[22] Filed: Jun. 22, 1994

Related U.S. Application Data

[63] Continuation of Ser. No. 882,553, May 13, 1992, abandoned.

[30] Foreign Application Priority Data

Mar. 16, 1992 [SE] Sweden ..... 9200804

[51] Int. Cl.[6] ..... C25B 1/16; C25B 1/22

[52] U.S. Cl. ..... 204/98; 204/104

[58] Field of Search ..... 204/93, 98, 104, 245, 204/252, 263, 264

[56] References Cited

U.S. PATENT DOCUMENTS

| | | | |
|---|---|---|---|
| 4,129,484 | 12/1978 | Larsson | 204/101 |
| 4,391,682 | 7/1983 | Struck et al. | 204/104 |
| 4,561,945 | 12/1985 | Coker et al. | 204/103 |
| 4,770,868 | 9/1988 | Norell | 423/479 |
| 5,091,166 | 2/1992 | Engström et al. | 423/478 |
| 5,091,167 | 2/1992 | Engström et al. | 423/478 |

FOREIGN PATENT DOCUMENTS

| | | | |
|---|---|---|---|
| 2023452 | 9/1991 | Canada . | |
| 0124007 | 11/1984 | European Pat. Off. . | |
| 0449071 | 10/1991 | European Pat. Off. ..... | B01D 61/44 |
| WO91/18830 | 12/1991 | WIPO . | |

*Primary Examiner*—Kathryn Gorgos

*Attorney, Agent, or Firm*—Leydig, Voit & Mayer

[57] ABSTRACT

The present invention relates to an electrochemical process for the production of sulphuric acid and alkali metal hydroxide, from an aqueous anolyte containing alkali metal sulphate. According to the invention, crystalline alkali metal sulphate is added to the anolyte, whereby the concentration of water can be maintained below about 55 percent by weight. In the electrolysis, the anolyte is brought to an electrochemical cell with a cation exchange membrane. In the cell, sulphuric acid and oxygen are formed in the anode compartment and alkali metal hydroxide and hydrogen in the cathode compartment. The steps normally preceding the electrolysis, i.e. dissolution and purification of the sulphate can be disposed of, since the process is less sensitive to impurities than the processes of the prior art. The present invention also relates to an apparatus for the production of sulphuric acid and alkali metal hydroxide according to the invention.

17 Claims, 1 Drawing Sheet

Figure 1:
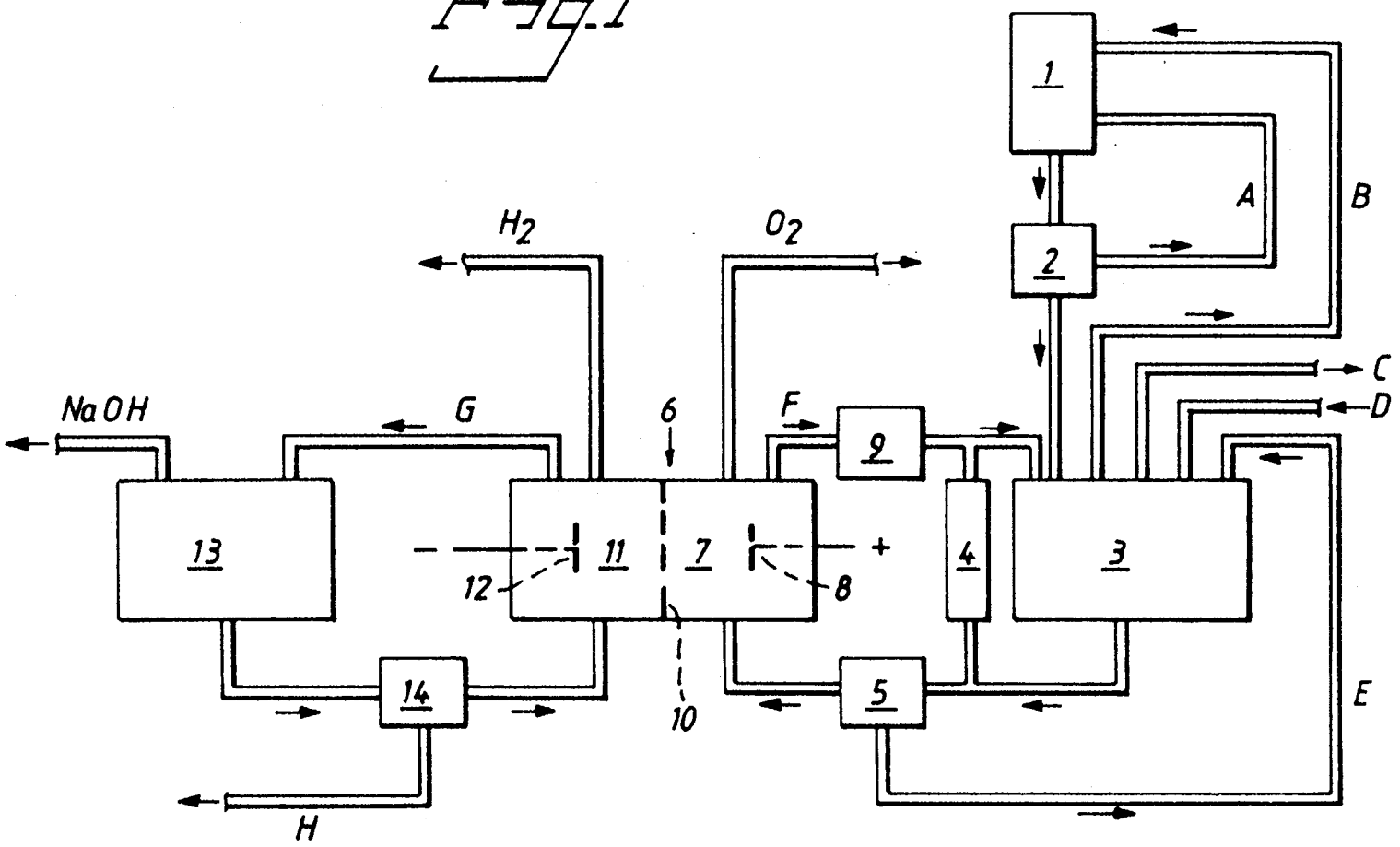

PROCESS AND APPARATUS FOR THE PRODUCTION OF SULPHURIC ACID AND ALKALI METAL HYDROXIDE

This application is a continuation of application Ser. No. 07/882,553, filed May 13, 1992, now abandoned.

The present invention relates to an electrochemical process and apparatus for the production of sulphuric acid and alkali metal hydroxide, from an aqueous anolyte containing alkali metal sulphate. According to the invention, crystalline alkali metal sulphate is added to the anolyte, whereby the concentration of water can be maintained below about 55 percent by weight. During electrolysis, the anolyte is brought to an electrochemical cell with a cation exchange membrane. In the cell, sulphuric acid and oxygen are formed in the anode compartment and alkali metal hydroxide and hydrogen in the cathode compartment. The steps normally preceding the electrolysis, i.e. dissolution and purification of the sulphate can be eliminated, since the process is less sensitive to impurities than the processes of the prior art. The use of crystalline sulphate makes it possible to produce sulphuric acid with a concentration of more than 20 percent by weight already in the cell, at an acceptable current efficiency. This means that the evaporation step normally used to increase the concentration of sulphuric acid after the electrolysis, also can be eliminated.

BACKGROUND

Precipitated or dissolved alkali metal sulphates are obtained in many diverse chemical processing operations, such as in the production of chlorine dioxide and rayon, flue gas scrubbing and pickling of metals. In some cases, the sulphate is a resource even though the value can be rather limited. Thus, sulphate obtained from the manufacture of chlorine dioxide can be used for tall oil splitting and as a make-up chemical in kraft mills or as a filler in detergents. However, the amount of sulphate used in these areas has decreased steadily due to changing processing conditions. Disposal of the sulphate into the water body surrounding the plant, means an environmental problem. Furthermore, this means increased production costs, arising from the chemicals needed for neutralization prior to discharge. Also, this means a lost resource since the sulphate usually has to be replaced with purchased chemicals. An efficient process to recover alkali metal sulphates in usable form and concentration has, therefore, been desirable for a considerable period of time.

Electrodialytic water splitting is a well known technology aimed at the problem with efficient recovery of sulphates. In this process, an aqueous solution containing sulphate of various origins is brought to an electrolyzer equipped with at least one diaphragm or membrane. By applying a direct electric current, the sulphate and water are split into ions, which react to produce sulphuric acid in the anolyte and a hydroxide in the catholyte.

In electrodialytic water splitting, the sulphate electrolyte used is normally purified. This has been considered especially important with membrane cells, which are much more sensitive to impurities than diaphragms. Thus, in the absence of substantial purification measures under alkaline conditions, magnesium and calcium hydroxide can precipitate in and on the membranes and on the electrodes. This will bring about increased operating voltage and reduced current yield. The purification commonly consists of precipitation and subsequent filtration followed by ion exchange. A requirement for this purification technique is the dissolution of the sulphate. This means that hitherto, the maximum concentration of sulphate in the anolyte feed has been limited by the solubility of the sulphate prior to electrolysis. The effect of this limitation has been a low concentration of sulphuric acid produced, i.e. normally in the order of 8–15 percent by weight.

According to EP 449071, alkali metal hydroxide and sulphuric acid are produced by electrodialytic water splitting of an aqueous solution containing dissolved sulphate. The three compartment membrane cell is equipped with special anion and cation exchange membranes, to reduce the sensitivity towards impurities and to allow for the production of concentrated sulphuric acid and hydroxide. For the same reasons, ammonium or amines are added to the sulphate solution fed to the intermediate salt compartment.

According to U.S. Pat. No. 4,129,484, chlorine dioxide is produced in a process by reducing chlorate with e.g. sulphur dioxide. The residual solution containing sulphate and unreacted sulphuric acid, is brought to an electrochemical membrane cell having two or three compartments where the sulphate is split. According to one embodiment, the cell is divided into two compartments by means of a cation exchange membrane. The residual solution is introduced into the anode compartment and the solution withdrawn from the anode compartment enriched in acid. This acid can be brought back to the chlorine dioxide generator, for further acidification in the reduction of chlorate.

Although several electrodialytic water splitting processes are known for the production of sulphuric acid and alkali metal hydroxide from alkali metal sulphate, the concentration of the products and the energy efficiency have hitherto been limited. Therefore, electrodialytic water splitting has not yet been widely recognized as an economic alternative when dealing with waste alkali metal sulphates. It is the aim of this invention to provide an efficient process with few steps, by which highly concentrated and pure products can be produced.

THE INVENTION

The present invention relates to a process by which sulphuric acid and alkali metal hydroxide can be produced efficiently, without purification of the sulphate before the electrodialytic water splitting step. The process comprises electrolysis of an aqueous anolyte containing alkali metal sulphate in an electrochemical cell with a cation exchange membrane, whereby the concentration of water in the anolyte is maintained below about 55 percent by weight by addition of crystalline alkali metal sulphate.

Thus, the invention concerns an electrochemical process for the production of sulphuric acid and alkali metal hydroxide as disclosed in the claims. According to the invention, bleeding of the anolyte has been substituted for the purification of sulphate fed to the electrochemical cell. The commonly used purification necessitates dissolution of the sulphate. By disposal of the dissolution and purification steps, the sulphate can be added in its original, crystalline state. The addition of crystalline rather than dissolved sulphate, makes possible the production of sulphuric acid with a concentration of more than 20 percent by weight at a current efficiency exceeding 60%.

Commonly, evaporation of the anolyte withdrawn has been used to increase the concentration of sulphuric acid. Evaporation of dilute sulphuric acid means investment in expensive equipment, e.g. because of potential corrosion problems. With the present process, this step can be eliminated, since the acid can be concentrated sufficiently for most purposes, already in the cell. Thus, the alkali metal sulphate, ion-exchange membrane, current efficiency and other operating conditions can be selected such that the concentration of sulphuric acid in the anolyte is at least about 20 percent by weight. The concentration of sulphuric acid in the anolyte is suitably in the range from 20 up to 25 percent by weight.

With the present process, it is possible to produce an anolyte with a high overall concentration of sulphuric acid and only diluted with a small amount of water. Thus, the main constituents of the anolyte will be sulphuric acid and reacted and/or unreacted alkali metal sulphate. The possibility to produce an anolyte with a low water content, means that the water balance problem in a chlorine dioxide generator can be eliminated. Also, the costs for transportation can be reduced if the anolyte is to be used at a distance from the electrochemical plant. Furthermore, the alkali metal sulphate present in the anolyte can often be considered as inert material accompanying the diluted sulphuric acid. Therefore, it is valuable to report the concentration of sulphuric acid in the portion of the anolyte only consisting of sulphuric acid and water. Thus, this so-called effective concentration is calculated as the weight ratio between the content of sulphuric acid and the total content of sulphuric acid and water in the anolyte. With the present process, the effective concentration of sulphuric acid can be up to about 40 percent by weight, suitably in the range from 25 up to 40 percent by weight and preferably in the range from 30 up to 35 percent by weight.

The concentration of water in the anolyte is maintained below about 55 percent by weight by the addition of crystalline alkali metal sulphate. The concentration of water in the anolyte is suitably maintained below 50 percent by weight and preferably below 45 percent by weight.

The advantage of the present process is besides the possibility to produce highly concentrated sulphuric acid without evaporation and also the limited purification of the raw material used in the process. By the present process, it has become possible to dispose of the dissolving, filtration as well as ion-exchange step used in conventional electrodialytic water splitting processes, except in cases where the sulphate used contains considerable amounts of impurities.

The alkali metal sulphate used in the present process should be crystalline prior to the addition to the anolyte. The sulphate can be added as dry or semi-dry particles or suspended in an aqueous slurry.

The alkali metal sulphate relates to all kinds of crystalline alkali metal sulphates and in any mixture. The crystalline nature of the sulphate can be original or obtained by precipitation. The sulphate can be precipitated either directly in the process where the sulphate is generated, or in an optional purification sequence prior to the electrodialytic water splitting. The alkali metal sulphate can be alkali metal sesquisulphate ($Me_3H(SO_4)_2$), neutral alkali metal sulphate ($Me_2SO_4$), Glauber's salt ($Na_2SO_4 \cdot 10H_2O$) or alkali metal bisulphate ($MeHSO_4$), where Me=alkali metal. Suitably, the alkali metal sulphate is alkali metal sesquisulphate and/or neutral alkali metal sulphate, preferably alkali metal sesquisulphate. The alkali metal is suitably sodium or potassium and preferably sodium. The most preferred sulphate is sodium sesquisulphate.

The alkali metal sulphate can be raw material used for the first time or material properly recycled for e.g. economic or environmental reasons. Examples of alkali metal sulphates properly recycled are residual solutions obtained in the production of chlorine dioxide, rayon and pigments of titanium dioxide. Suitably, the alkali metal sulphate is obtained in the production of chlorine dioxide. In all low pressure chlorine dioxide generating processes, adequate material is obtained. Such processes have been developed by Eka Nobel AB in Sweden and are described e.g. in the U.S. Pat. Nos. 4,770,868, 5,091,166 and 5,091,167 which are hereby incorporated by reference.

Another such process, also developed by Eka Nobel AB, is described in European Patent Application 90850420 and relates to the production of chlorine dioxide in the substantial absence of added chloride ions with chlorate molarity above about 2.0 and acidity up to about 9.0 normal.

The anolyte feed can be passed once through the anode compartment of a single cell. However, the increase in the concentration of sulphuric acid will be very limited, even if the anolyte is transferred through the cell at a very low flow rate. Therefore, it is suitable to bring the flow of anolyte withdrawn from the cell to an anode compartment for further electrolysis, until the desired concentration of sulphuric acid and/or alkali metal hydroxide has been obtained. The anolyte withdrawn can be recirculated to the same anode compartment or brought to another anode compartment. Suitably two or more cells are connected in a stack, in which the anolyte and catholyte flow through the anode and cathode compartments, respectively. The cells can be connected in parallel, in series or combinations thereof, so-called cascade connections.

The concentration of alkali metal hydroxide produced can be up to about 30 percent by weight, suitably in the range from 10 up to 20 percent by weight.

The addition of crystalline alkali metal sulphate to the depleted anolyte can be carried out continuously or intermittently, suitably continuously. The sulphate can be added to a tank through which the anolyte is recirculated. It can also be added to a dissolving tank, through which a portion of the anolyte is recirculated. A filter is suitably inserted between the tanks and the anode compartment to remove undissolved sulphate. This undissolved, crystalline sulphate can be returned to the dissolving or recirculation tank, where the crystalline sulphate is added.

The concentration of alkali metal sulphate in the anolyte should be as high as possible without causing precipitation, to allow for a high concentration of sulphuric acid in the anolyte. The saturation concentration is specific for each alkali metal sulphate and dependent on the prevailing conditions, such as temperature, pressure and the total concentration of protons. The saturation concentration for sodium sesquisulphate at atmospheric pressure and 60° C. is from about 32 up to about 37 percent by weight, depending on the total concentration of protons.

The alkali metal sulphates and process water normally contain impurities. Examples are ions of alkaline earth metals, such as $Ca^{2+}$ and $Mg^{2+}$ ions of metals such as Cd, Cr, Fe and Ni and organic trash. The present process is rather insensitive to these impurities, i.e. the content of impurities in the anolyte and catholyte can be relatively high without causing substantial problems in the electrolysis step. However, the total content of impurities should suitably be below about 100 ppm by weight and preferably below 30 ppm by weight.

Since the present process is rather insensitive to impurities, it is suitable to add crystalline sulphate of technical quality to the anolyte without prior purification. However, purification can be used if the total content of impurities in the anolyte is high or if especially detrimental compounds or ions are present. In this case, a portion of the sulphate to be added to the anolyte can be purified by techniques well known to the artisan. Thus, alkaline earth metal ions and metal ions can be removed by increasing the pH whereby the corresponding hydroxides precipitate. A subsequent careful filtration, will reduce the concentration considerably. The presence of multivalent ions would, in some cases, require further purification by way of ion exchange. The sulphate purified is subsequently precipitated by e.g. cooling or evaporation. The sulphate crystals obtained are then added to the anolyte.

Although the present process allows for a higher concentration of impurities than conventional processes, a bleed is necessary to avoid accumulation of the impurities to a level where they start to constitute a problem. Therefore, it is suitable to remove a portion of the flow of anolyte from the cell. This portion can be in the range from about 1 up to about 10% of the total flow of anolyte withdrawn from the anode compartment of the cell. The portion removed, is suitably in the range from 1 up to 5% and preferably from 2 up to 3%. The thus removed anolyte can be used as such, e.g. for regulation of the pH, evaporated to increase the concentration of the acid or purified.

In the slurry containing crystalline sulphate, the amount of water can be less than or equal to the amount necessary to compensate for the water split in the electrolyser and the water transported through the membrane. The remaining water or, if the sulphate is added as dry or semi-dry particles all of the water, can be added anywhere in the anolyte circulation, suitably in the dissolving tank. Prior to the addition, the water can be raw or purified. By purifying the water, the portion of anolyte removed as a bleed can be reduced. Therefore, the water is suitably purified, to reduce the concentration of e.g. $Ca^{2+}$ and $Mg^{2+}$. This can be carried out by well known techniques such as ion exchange.

The economy of the electrodialytic water splitting, is mainly dependent on the competition between the chemical reactions which result in useful products and more or less useless products. With alkali metal sulphate, the amount of sulphuric acid and alkali metal hydroxide produced is smaller than the equivalent of the electrolytic current. This is because protons migrate through the membrane and to at least some extent so do hydroxyl ions. With a cation exchange membrane, the protons migrate from the anolyte to the catholyte where they react with the hydroxyl ions to water. This reduces the current efficiency, which is dependent on e.g. the concentration of the electrolyte feed and products produced, type of membrane, current density and temperature of the electrolyte. The current efficiency should be maintained above about 50%. The current efficiency is suitably maintained in the range from 55 up to 100% and preferably in the range from 65 up to 100%.

The mixture of sulphuric acid and alkali metal sulphate and the alkali metal hydroxide produced, can be used for all types of chemical processes. It is however, advantageous to use the products in the pulp and paper industry, suitably in the pulp industry. Suitably, a portion of the flow of anolyte removed from the cell containing a mixture of sulphuric acid and alkali metal sulphate, is used in the production of chlorine dioxide, preferably in a low pressure chlorine dioxide process. The alkali metal hydroxide can be used to prepare cooking and alkaline extraction liquors for lignocellulose-containing material. The oxygen gas evolved from the anode compartment, can be used in the delignification and brightening of cellulose pulp. The hydrogen gas evolved from the cathode compartment, can be used for energy production or as a raw material in the production of hydrogen peroxide.

Electrochemical cells are well known as such and any conventional cell with a cation exchange membrane can be used in the invention. Principally, a two compartment electrochemical cell contains one or more cathodes, one or more anodes and between them a membrane. A three compartment electrochemical cell contains two membranes between the anodes and cathodes, one of which is of the cation exchange type and the other of the anion exchange type. With a three compartment cell, it is possible to produce sulphuric acid and alkali metal hydroxide with a lower content of alkali metal sulphate, than with a two compartment cell. The main drawbacks are the low effective concentration of sulphuric acid. Therefore, the electrochemical cell is suitably a two compartment cell.

The membrane used in the electrochemical cell of the present invention can be homogeneous or heterogeneous, organic or inorganic. Furthermore, the membrane can be of the molecular screen type, the ion-exchange type or salt bridge type. The cell is suitably equipped with a membrane of the ion-exchange type.

Organic cation exchange membranes are based on negatively charged ions, e.g. sulphonic acid groups. The use of a cation exchange membrane in the present process, makes it possible to produce concentrated sulphuric acid. Also, a cation exchange membrane suppresses the migration of sulphate ions into the cathode compartment. Thus, with a cation exchange membrane in a two compartment cell, it is possible to produce pure alkali metal hydroxide and a mixture of concentrated sulphuric acid and sodium sulphate. This is a suitable combination of products and concentrations for the pulp industry, which as already stated above is the preferred end-user for the products produced. Suitable cation membranes are Nafion 324 and Nafion 550, both sold by Du Pont of the USA, and Neosepta CMH sold by Tokuyama Soda of Japan.

Organic anion exchange membranes are based on positively charged ions, e.g. quaternary ammonium groups. An anion exchange membrane can be inserted between the cation exchange membrane and the anode, thereby creating a three compartment cell. By feeding the solution containing alkali metal sulphate to the intermediate compartment and applying voltage, pure alkali metal hydroxide can be produced in the cathode compartment. Pure dilute sulphuric acid can be produced in the anode compartment, since the sulphate ions migrate through the anion exchange membrane. In the intermediate compartment, the solution withdrawn will be depleted in alkali metal sulphate. Suitable anion membranes are Selemion ® AAV sold by Asahi Glass, Neosepta ® AMH sold by Tokuyama Soda, and Tosflex ® SA 48 sold by Tosoh, all companies of Japan.

The electrodes can be e.g. of the gas diffusion or porous net type. A cathode and anode with a low hydrogen and oxygen overpotential, respectively, are necessary for an energy efficient process. The electrodes can be activated to enhance the reactivity at the electrode surface. It is preferred to use activated electrodes. The material of the cathode may be graphite, steel, nickel or titanium, suitably activated nickel. The material of the anode can be noble metal, noble metal oxide, graphite, nickel or titanium, or combinations thereof. The anode is suitably made of a noble metal oxide on a titanium base, known as dimensionally stable anodes (DSA).

The current density can be in the range from about 1 up to about 15 $kA/m^2$, suitably in the range from 1 up to 10 $kA/m^2$ and preferably in the range from 2 up to 4 $kA/m^2$. The temperature in the anolyte can be in the range from about 50 up to about 120° C., suitably in the range from 60 up to 100° C. and preferably in the range from 65 up to 95° C.

The process of the present invention will now be described in more detail with reference to FIG. 1. FIG. 1 shows a schematic description of a plant to split sodium sesquisulphate into a mixture of sulphuric acid and sodium bisulphate and pure sodium hydroxide, respectively. The electrochemical cell is equipped with a cation exchange membrane between the two compartments of the cell. Of the anolyte withdrawn, the main portion is recirculated to the anode compartment, whereas a minor portion is removed from the recirculation and used in the generation of chlorine dioxide. Another minor portion of the anolyte withdrawn from the cell, is removed as a bleed.

The residual solution from a chlorine dioxide generator (1) containing a mixture of crystalline sodium sesquisulphate and generator solution is continuously removed from the generation system. The sesquisulphate is recovered on a generator filter (2). The filter can be a rotating drum filter. The mother liquor, containing only dissolved material and saturated with respect to sodium sesquisulphate, is returned (A) from the filter to the chlorine dioxide generator. The crystalline sodium sesquisulphate is brought to the dissolving tank (3) together with make-up water (D) and depleted anolyte (F) from the anode compartment (7) of the cell (6). The depleted anolyte is close being saturated with respect to sodium sesquisulphate. In (3), the temperature of the anolyte is regulated to within the range from 65 up to 95° C. The saturated or close to saturated anolyte feed thus prepared, with a concentration of from 30 up to 37 percent by weight of sodium sulphate and with a concentration of water of from 49 up to 51 percent by weight, is brought to an anolyte filter (5) to remove any undissolved sulphate. The undissolved, crystalline sulphate can be returned (E) to the dissolving tank (3). Subsequently, the anolyte feed is brought to the anode compartment of the cell. When voltage is applied to the cell, the water will be split into oxygen gas and protons at the anode (8). The current density is suitably in the range from 2.0 up to 4.0 $kA/m^2$ and the current efficiency suitably maintained at 65–70%. The oxygen gas leaves the cell by way of a gas vent, while the protons mainly remain in the anolyte forming bisulphate ions and sulphuric acid together with the liberated sulphate ions. The anolyte depleted in water and sodium sesquisulphate and enriched in sulphuric acid and sodium bisulphate, is withdrawn (F) from the top of the cell and, by way of a pump (9), brought to the dissolving and anolyte recirculation tank (4). When the effective concentration of sulphuric acid is sufficient, suitably in the range from 25 up to 40 percent by weight, a portion of the anolyte can be removed (B) to be used in the chlorine dioxide generator (1). Another portion of the anolyte withdrawn from the cell, about 2–3%, is removed as a bleed (C), to avoid accumulation of impurities in the system. The acid used in the generator as well as the bleed can be removed from the dissolving tank (3), anolyte recirculation tank (4) and/or directly from the top of the cell. The sodium ions liberated from the sesquisulphate, migrate through the cation exchange membrane (10) into the cathode compartment (11) of the cell. Each sodium ion is accompanied by about four water molecules. In (11), the water is split into hydrogen gas and hydroxyl ions at the cathode (12). The hydrogen gas leaves the cell by way of a gas vent, while the hydroxyl ions together with the sodium ions form sodium hydroxide. The catholyte enriched in hydroxide is withdrawn (G) at the top of the cell and brought to the catholyte recirculation tank (13). The catholyte is recirculated to the cathode compartment, by way of a catholyte filter (14). In the filter, mainly precipitated hydroxides of calcium and magnesium are removed (H). When the concentration of sodium hydroxide is sufficient, suitably in the range from 15 up to 25 percent by weight, a portion of the catholyte can be removed to be used in the cooking or bleaching department of the pulp mill.

The apparatus for carrying out the process of the invention comprises means (3) for dissolving the crystalline alkali metal sulphate added, means (5) for filtering the anolyte to remove undissolved sulphate, means (6) for electrolysis of the aqueous anolyte containing alkali metal sulphate and means (9) to circulate the anolyte through (3), (5) and (6). The figures within brackets refer to FIG. 1. The means (6) for electrolysis of the aqueous anolyte containing alkali metal sulphate, is preferably an electrochemical cell with an anode compartment (7) and a cathode compartment (11), separated by a cation exchange membrane (10). The means (9) to circulate the anolyte through (3), (5) and (6), is suitably a pump.

The invention and its advantages are illustrated in more detail by the following examples which, however, are only intended to illustrate the invention and not to limit the same. The percentages and parts used in the description, claims and examples, refer to percentages by weight and parts by weight, unless otherwise specified.

EXAMPLE 1

A residual solution from a chlorine dioxide generator was filtered to obtain crystalline sodium sesquisulphate. An anolyte was prepared by dissolving the crystalline sodium sesquisulphate in deionized water. The concentration of sodium sesquisulphate in the anolyte was initially 380–440 g/liter. Crystalline sodium sesquisulphate was added continuously to the circulating anolyte, when the electrolysis started. The concentration of sodium hydroxide in the catholyte was kept constant at 100 g/liter by feeding deionized water and bleeding the hydroxide produced. Use was made of a two-compartment electrochemical SYN-cell ® supplied by Elektrocell AB of Sweden. The two compartments were separated by a Nafion 324 cation exchange membrane. A cathode of nickel and DSA-$O_2$ anode of titanium were used and the electrode area and gap were 4 $dm^2$ and 4 mm, respectively. The cell was operated at a temperature of 70° C. with a current density of about 3 $kA/m^2$ for at least 5 hours.

At a water concentration in the anolyte of about 50 percent by weight, the overall concentration of sulphuric acid was 20.5 percent by weight, i.e. the effective concentration of sulphuric acid was 29 percent by weight. The overall current efficiency was above 65%. The overall energy consumption was about 4800 kWh/ton of NaOH produced.

EXAMPLE 2

Another test was run according to the conditions in Example 1. At a water concentration in the anolyte of 50.5 percent by weight, the overall concentration of sulphuric acid was 20.5 percent by weight, i.e. the effective concentration of sulphuric acid was 28.9 percent by weight. The overall current efficiency was above 67%. The overall energy consumption was about 4600 kWh/ton of NaOH produced.

We claim:

1. A process for the production of sulfuric acid and alkali metal hydroxide, comprising electrolyzing an aqueous anolyte containing alkali metal sulfate in an electrochemical cell with a cation exchange membrane, thereby forming sulfuric acid in the anolyte wherein the concentration of water in the anolyte is maintained below about 55 percent by weight by addition of crystalline alkali metal sulfate and producing alkali metal hydroxide in the catholyte.

2. A process according to claim 1, wherein the alkali metal sulfate includes alkali metal sesquisulfate or neutral alkali metal sulfate.

3. A process according to claim 2, wherein the alkali metal sulfate is obtained from a process for producing chlorine dioxide.

4. A process according to claim 2, wherein the alkali metal sulfate is added continuously.

5. A process according to claim 1, wherein the alkali metal sulfate is obtained from a process for producing chlorine dioxide.

6. A process according to claim 5, wherein the alkali metal sulfate is added continuously.

7. A process according to claim 1, wherein the alkali metal sulfate is added continuously.

8. A process according to claim 1, wherein the concentration of water in the anolyte is maintained below 50 percent by weight.

9. A process according to claim 1, wherein the current efficiency of the electrolysis is maintained above about 50%.

10. A process according to claim 1, wherein the electrolysis is carried out so that the concentration of sulfuric acid in the anolyte is at least about 20 percent by weight.

11. A process according to claim 1, including the step of withdrawing the anolyte from the cell, adding further crystalline alkali metal sulfate to the withdrawn anolyte and further electrolyzing the anolyte by recycling to the anode compartment of said cell or to an anode compartment of a second cell.

12. A process according to claim 1, including the step of withdrawing a portion of the flow of anolyte from the cell to avoid accumulation of impurities in the anolyte.

13. A process according to claim 1, wherein the combination of temperature, pressure and total concentration of protons is regulated such that precipitation of alkali metal sulfate in the anolyte is avoided.

14. A process for the production of sulfuric acid and alkali metal hydroxide, comprising adding crystalline alkali metal sulfate to an aqueous anolyte, removing an undissolved portion of the alkali metal sulfate added, and electrolyzing the anolyte in an electrochemical cell with a cation exchange membrane, thereby forming sulfuric acid in the anolyte, wherein the concentration of water in the anolyte is maintained below about 55 percent by weight and producing alkali metal hydroxide in the catholyte.

15. A process according to claim 14, wherein the undissolved alkali metal sulfate is removed by filtering between a dissolving or recirculating tank and an anode compartment of the electrochemical cell.

16. A process according to claim 14, wherein the combination of temperature, pressure and total concentration of protons is regulated such that precipitation of alkali metal sulfate in the anolyte is avoided.

17. A process according to claim 14, including the step of withdrawing the anolyte from the cell, adding further crystalline alkali metal sulfate to the withdrawn anolyte and further electrolyzing the anolyte by recycling to an anode compartment of said cell or to an anode compartment of a second cell.

* * * * *